United States Patent [19]

Burkhardt

[11] Patent Number: 4,527,792

[45] Date of Patent: Jul. 9, 1985

[54] APPARATUS FOR CHANGING THE DIRECTION OF MOTION OF LETTERS AND SIMILAR RECTANGULAR PIECES OF MAIL

[75] Inventor: Gisbert Burkhardt, Reichenau, Fed. Rep. of Germany

[73] Assignee: Licentia-Patent-Verwaltungs GmbH, Fed. Rep. of Germany

[21] Appl. No.: 411,339

[22] Filed: Aug. 25, 1982

[30] Foreign Application Priority Data

Aug. 29, 1981 [DE] Fed. Rep. of Germany ..... 3134266

[51] Int. Cl.[3] ..... B65H 5/00

[52] U.S. Cl. ..... 271/225; 198/412; 271/184; 271/251

[58] Field of Search ..... 271/225, 184, 185, 251; 198/412, 457

[56] References Cited

U.S. PATENT DOCUMENTS

| | | | |
|---|---|---|---|
| 1,736,482 | 11/1929 | Broadmeyer | 271/182 |
| 3,380,734 | 4/1968 | Laumer | 271/202 |
| 3,470,998 | 10/1969 | Zuercher | 198/457 |
| 3,685,471 | 8/1972 | Reynolds | 198/412 |
| 4,248,413 | 2/1981 | Fox | 271/184 |
| 4,314,644 | 2/1982 | Stocker | 271/225 |

FOREIGN PATENT DOCUMENTS

| | | |
|---|---|---|
| 907520 | 2/1954 | Fed. Rep. of Germany . |
| 1116602 | 9/1965 | Fed. Rep. of Germany . |
| 1199697 | 3/1966 | Fed. Rep. of Germany . |
| 6605273 | 5/1970 | Fed. Rep. of Germany . |

*Primary Examiner*—Bruce H. Stoner, Jr.
*Assistant Examiner*—John A. Carroll
*Attorney, Agent, or Firm*—McGlew and Tuttle

[57] ABSTRACT

An apparatus for changing the direction of motion of rectangular pieces of mail from a path parallel to a long edge of the pieces of mail to a path parallel to the short edge thereof, comprises a first conveying segment having an end section which moves the pieces of mail in a direction parallel to their long edge but displaceable so that the pieces of mail can be moved in addition by another mechanism. At the end of the first conveying segment, a first deflecting device is provided for engaging a leading edge of the pieces of mail and deflecting them for movement into a second direction but, at the same time, holding the pieces of mail so their edges remain parallel throughout the operation. A second conveying segment is provided for receiving the pieces of mail from the first deflecting device and conducting the pieces of mail along the second direction to a second deflecting device. The downstream end of the second conveying segment also includes a section which permits displaceable conveyance of the pieces of mail, that is conveyance of the pieces of mail while permitting movement of the pieces of mail by another device. The second deflecting device seizes the pieces of mail as they come from the second conveying segment and conduct them, again in parallel orientation, into a third direction which is substantially at 90° to the first direction.

15 Claims, 8 Drawing Figures

Fig. 3
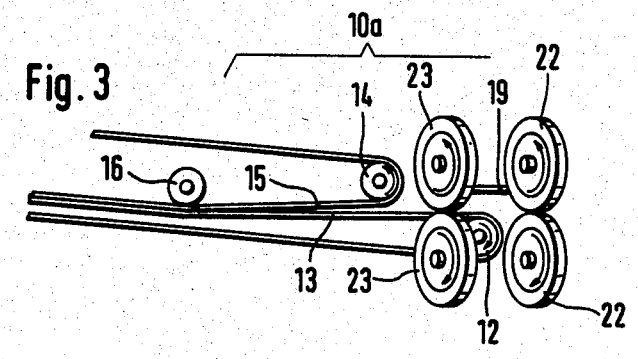
Fig. 4
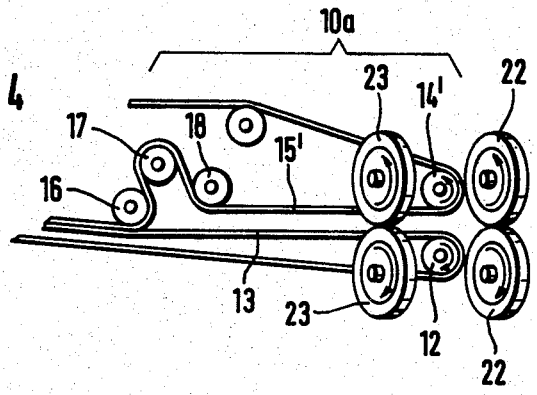
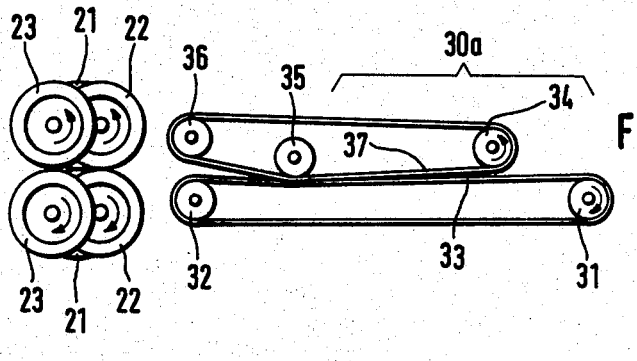
Fig. 5
Fig. 6
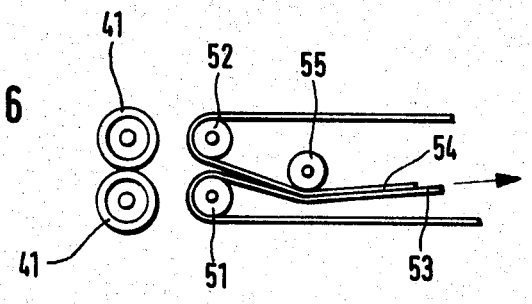

APPARATUS FOR CHANGING THE DIRECTION OF MOTION OF LETTERS AND SIMILAR RECTANGULAR PIECES OF MAIL

FIELD AND BACKGROUND OF THE INVENTION

The invention relates to an apparatus for changing the direction of motion of letters and similar rectangular pieces of mail which are oncoming in the direction of their long edges, in a manner such that they leave in the direction of their short edges.

In mail sorting machines, for example, the pieces of mail are conveyed in the direction of either their long edges or their short edges, depending on the design of the segments of the distributing lines. The conveyance in the direction of the short edges has the advantage that the sought sorting capacity (in letters per unit time) can be obtained with a lower conveying speed, since with the same space in between latters, their width is the determining factor, not their length. However, since as a rule, the initially stacked letters are removed (singled out) from the stack in the direction of their long edges, a device is needed by which the position of direction of motion of the letter is correspondingly changed.

Such an apparatus for changing the direction of motion of letters in the above-mentioned manner is disclosed in German AS No. 11 99 697, for example. The pieces of mail moved in upright position in a conveying line segment in the direction of their long edges run against a fixed stop and are then removed vertically upwardly, thus in the direction of their short edges. As known from experience with that apparatus in use, the vertical conveying line segment is equipped with equidistantly spaced fingers engaging the individual stopped letters at the lower long edge thereof. Therefore, this apparatus is usable only for a conveyance in synchronism, i.e. the pieces of mail must arrive at the fingers with equally spaced leading edges and in definite time intervals.

To avoid this restriction, the removal upwardly had to be effected, for example, by means of a pair of seizing rollers controlled through the arrival of individual letters, which causes problems of wear and noise. Further difficulties arise in both instances from the necessity of braking the letters within a short distance from the full conveying speed to zero speed, and not even the use of a brush roller as provided in the mentioned German AS No. 11 99 697 can completely overcome this problem.

SUMMARY OF THE INVENTION

The invention is directed to an apparatus of the above mentioned kind for permitting any desired "asynchronous" sequence of motion of the pieces of mail causing no problems of wear and noise, and exposing the pieces of mail passing therethrough to minimum decelerating or accelerating forces, so that even at high conveying speeds, the operation of the apparatus remains relatively independent of the respective mechanical properties of the mail (such as weight, rigidity, and location of the center of gravity).

To solve the foregoing problem, an object of the present invention is to provide an apparatus for changing the direction of motion of pieces of mail having a long edge and a short edge, from the direction of their long edge to the direction of their short edge, comprising, a first conveying segment extending in a first direction for feeding a piece of mail in a plane with its long edge moving along a reference line, the first conveyin segment having a first conveying section at a down stream end thereof in which the piece of mail is dis placeably moved in the first direction, a first deflectin device including conveying means by which the piec of mail is seized at a leading edge thereof and the moved parallelly away from the first conveying sectio in a second direction which forms an acute angle wit the first direction, a second conveying segment whic extends in the second direction for seizing the piece o mail moved by the first deflecting device, the secon conveying segment having a second conveying sectio at a downstream end thereof in which the piece of mai is displaceably moved in the second direction, and second deflecting device including conveying means b which the piece of mail is seized and moved parallell laterally away from the second conveying section in third direction which forms an angle greater than th acute angle, preferably a 90° angle with the first direc tion.

Another object of the invention is to provide an appa ratus for changing the direction of movement of a piec of mail which is simple in design, rugged in constructio and economical to manufacture.

For an understanding of the principles of the inven tion, reference is made to the following description o typical embodiments thereof as illustrated in the accom panying drawings.

BRIEF DESCRIPTION OF THE DRAWINGS

In the Drawings:

FIG. 3 is a view of the first conveying section and the first deflecting device, taken in the direction of arrow A in FIG. 2;

FIG. 4 shows a modification of the first conveying section shown in FIG. 3;

FIG. 5 is a view of the first deflecting device and the second conveying segment, taken in the direction o arrow B in FIG. 2;

FIG. 6 is a view of the second deflecting device anc the third conveying segment, taken in the direction o arrow C in FIG. 2;

DESCRIPTION OF THE PREFERRED EMBODIMENTS

Figure 1:
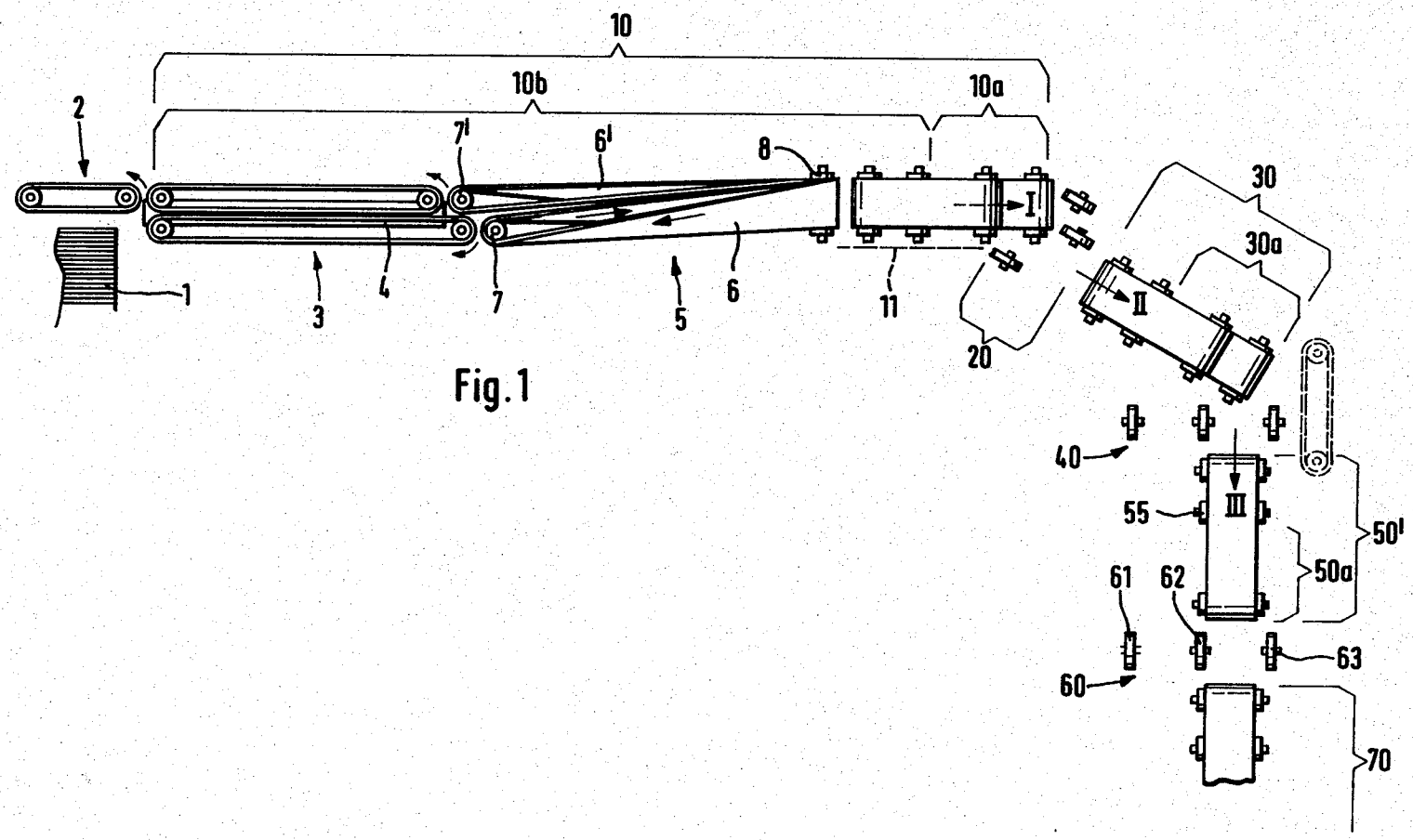
FIG. 1 is a diagrammatically simplified top plan view of an inventive apparatus with further equipment, as part of a mail sorting system.

According to FIG. 1, the pieces of mail (letters) 1 tc be handled are initially received as a stack in a separato 2 by which they are individually removed to the right ir the direction of their long edges and forwarded in up right position to a first conveying segment 10. This segment extends in a first direction I and includes conveying mechanism **10*b* and, at its exit, a first convey ing section 10*a*** in which the pieces of mail are movec along displaceably by another device, if present.

Conveying mechanism **10*b* is intended to feed the pieces of mail 1 in the first direction I in a manner suck that they come into a substantially horizontal positior and that prior to entering conveying section 10***a*, their long edges move along a predetermined reference line 11. The design of this conveying mechanism therefore depends on the initial position of the pieces of mail, in which they are received by the mechanism.

In the present example, conveying mechanism 10*b* comprises an aligning section 3 in which the pieces of mail which are oncoming in upright position are aligned so as to repose by their lower long edge on a reference plane 4, and a turning section 5 in which the pieces of mail are immovably seized and turned about a predetermined axis which extends in the conveying direction I and in the plane of the pieces of mail, through 90°. Then they are in a position in which their initially lower edge moves along reference line 11.

A mechanism having the properties of aligning section 3 is known from German Pat. No. 11 16 602, for example. The turning section 5 is also known in various designs. According to FIG. 1, this section comprises a first endless belt 6 which is trained about a vertical roller 7 and a horizontal roller 8, and an endless belt 6' which applies against the first belt and is trained about a vertical roller 7' and another horizontal roller extending below roller 8.

The first conveying section 10*a* will be explained hereinafter, with reference to FIGS. 2 to 4. This section is followed by a first deflecting device 20 comprising conveying means by which pieces of mail 1 are seized at their leading edge and moved in parallel position laterally away from the first conveying section, in a second direction II which forms an acute angle $\alpha < 45°$ with the first direction I.

Extending in the second direction II, is a second conveying segment 30 by which the pieces of mail which moves from device 20 are seized and whose exit portion is formed by a second conveying section 30*a* in which the pieces of mail are displaceably moved along.

Figure 7:
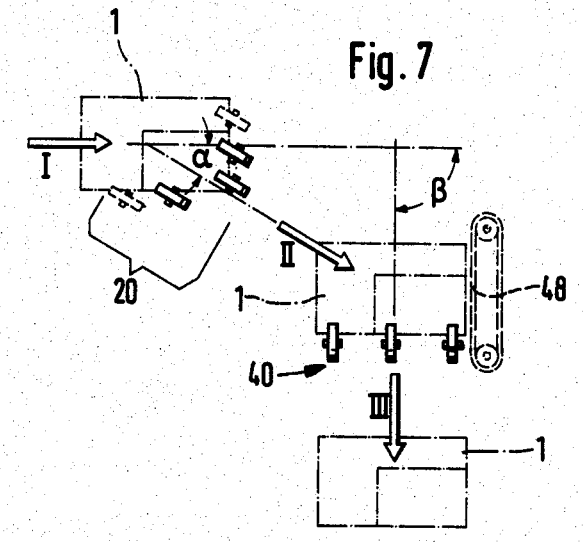
FIG. 7 is a diagrammatical illustration of the opera tion of the inventive apparatus.

The inventive apparatus further comprises a second deflecting device 40 with conveying means by which the pieces of mail are seized at their oncoming long edge and moved in parallel position laterally away from the second conveying section 30*a* as shown in FIG. 7, in a third direction forming an angle $\beta$ substantially of 90° wth the first direction I, so that the desired change in the direction of motion of the mail is achieved.

As a further development of the invention, FIG. 1 also shows a third conveying segment 50', a retarding device 60, and a conveying mechanism 70, having purposes which will be explained hereinafter.

Figure 2:
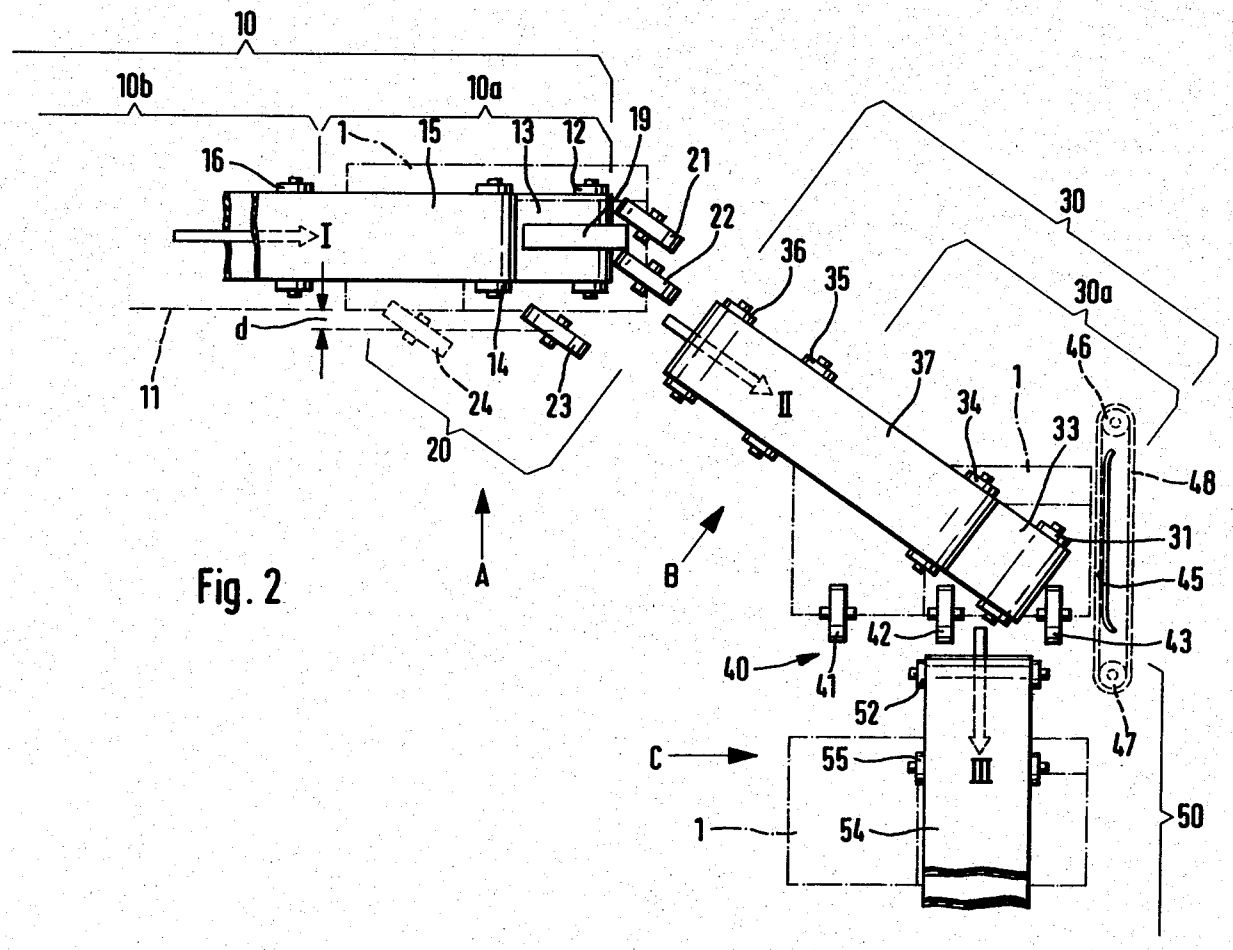
FIG. 2 is an enlarged, partly diagrammatical view o a part of FIG. 1, with the elements which are character istic of the operation of the apparatus.
Figure 8:
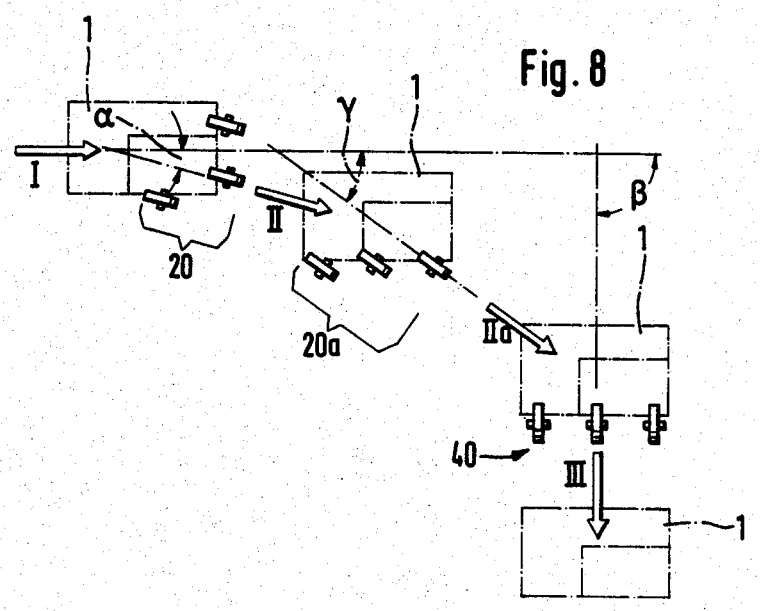
FIG. 8 is a view similar to FIG. 7, showing a modifi cation of the inventive apparatus.

In FIGS. 2,7 and 8, some pieces of mail 1 are shown in positions which are characteristic of the manner in which the apparatus operates, and as superposed, quasi-transparent small-size and large-size pieces.

As already mentioned, conveying section 10*a* is intended to move the pieces of mail, which have arrived with their long edges in register with reference line 11, displaceably along, i.e. in a manner such that they can be moved by an additional external force differently from their hitherto conveying direction I or conveying speed. In the discussed example, this is obtained by the following design:

As shown in FIGS. 2 and 3, conveying section 10*a* includes a lower conveyor belt 13 which is run, among others, around a driven roller 12 and on which the pieces of mail 1 are carried. There above, an upper belt 15 runs over a roller 14 at the same speed and in a manner so as to exert no, or only a slight, contact pressure on the mail. This is obtained, in accordance with FIG. 2, by providing that belt 15 diverges by a small angle upwardly from belt 13 and from a common back-up roller 16.

FIG. 4 shows a modification in which by means of guide rollers 17 and 18 and roller 14', belt 15' are trained to run at a small distance from, and parallel to, conveyor belt 13. Even though belt 15' does not contact the mail in this design, it substantially assists in a reliable carrying of the mail along in the conveying direction I, because a corresponding air flow is thereby produced and maintained. In the design of FIGS. 2 and 3, it may be advisable to provide a guide surface 19 above the non-covered end portion of conveyor belt 13.

The first deflecting device 20 comprises a plurality of driven conveying rollers which cooperate in pairs and are correspondingly aligned with a second conveying direction II. At least two pairs of conveying rollers 21,22 are disposed in the conveyance path of mail pieces 1 so that they seize the leading edge of the respective advanced piece substantially simultaneously. In addition, at least one further pair of conveying rollers 23, serving to engage the long edge, is so disposed that its zone of seizure (i.e. the nip or line along which the rollers contact each other) is slightly spaced, by a distance d, from reference line 11. If the sizes of the pieces to be handled vary largely, further conveying rollers may be added to the mentioned ones, such as roller 24 indicated in broken lines in FIG. 2.

Thus, in contradistinction to the prior art apparatus, in this design the leading edge of a piece of mail 1 does not run against a stop but passes during its motion within first conveying section 10*a* and in conveying direction I into the seizure zone of the two pairs of conveying rollers 21 and 22 whose circumferential speed in the second conveying direction II has a speed component in the first direction I, which component is considerable in any case. It is even possible and still within the scope of the invention to provide such a speed in conveying direction II that the mentioned speed component is equal to the initial conveying speed in the first direction I. In general, however, the conveying speeds of the first deflecting device 20 and of the second deflecting device 40 are determined empirically so as to obtain optimal operating conditions.

After its leading edge has been seized by conveying roller pairs 21 and 22, the piece of mail 1 is positively displaced by parallel translational shifting, laterally away from conveying section 10*a* in the direction II. Immediately thereafter, in addition, the initially lower long edge comes into the seizure zone of conveying rollers 23 (or 23 and 24) which assist the displacement of the mail pieces into the second conveying segment 30.

In the embodiment shown in FIGS. 2 and 5, conveying segment 30 comprises a conveyor belt 33 trained over rollers 31 and 32, and a belt 37 which is run thereabove by means of rollers 34,35 and 36. These last mentioned rollers are so arranged that the oncoming pieces of mail are initially seized relatively rigidly while in the exit zone forming the second conveying section 30*a*, they are carried along displaceably.

The second deflecting device 40 comprises three pairs of conveying rollers 41,42 and 43 which are so disposed that their seizure zone (i.e. the straight line connecting their contact lines) extends substantially parallel to reference line 11. As soon as the piece of mail 1 passes by its leading long edge into this seizure zone, it is tranlationally shifted by the mentioned conveying rollers and pulled laterally away from second conveying section 30*a* in the third direction III.

FIG. 2 shows a third conveying segment 50 which also extends in the third direction III, in continuation of the path along which the pieces of mail are moved away by deflecting device 40, and comprises two conveyor belts 53 and 54 run over rollers 51 and 52. By means of a back-up roller 55, these conveyor belts are trained in such a way that the oncoming pieces of mail are seized and also carried along rigidly. Even though, as a rule, the described two deflections in the path of motion of the pieces of mail are completely satisfactory for solving the problem posed, it may be advantageous under particularly unfavorably operating conditions, given especially by the nature of the pieces of mail, to insert another deflecting device 20*a*, as shown in FIG. 8, between second conveying section 30*a* and second deflecting device 40, comprising conveying means (particularly such as pairs of conveying rollers) by which the pieces of mail are seized by their leading long edge and laterally shifted in translational motion away from the conveying section in a direction IIa which is intermediate between the directions II and III. Direction IIa thus forms an angle $\gamma$ with the initial conveyance direction I, satisfying the condition of $\alpha<\gamma<\beta$. Then, deflecting device 20*a* would be followed by another conveying section in which pieces of mail are carried along displaceably in the direction IIa.

It may also be advantageous to provide a stop surface 45 in the zone of second deflecting device 40 or the additional deflecting device 20*a*. Such a surface would be provided at the location where the short leading edge of mail pieces 1 is at the instant at which the long edge thereof has come into the seizure zone of conveying rollers 41 to 43 or of other means for conveying the pieces laterally away.

This stop may prevent particularly heavy pieces of mail, or such having their center of gravity located unfavorably, from passing into an undesirable position, due to inertia forces. According to another development, this stop surface may be designed as a conveyor belt 48 trained over rollers 46 and 47.

What is obtained by employing the inventive apparatus comprising the functional groups described in the foregoing is that the pieces of mail fed in in the direction of their long edge leave with a minimum of noise and without disturbances in the direction III which is perpendicular thereto, with their short edges, as a rule, moving with a satisfactory accuracy in this direction III. Under particularly unfavorable operating conditions, or if, for some reason, a particularly accurate alignment of the mail pieces is needed, the apparatus may be designed with the following functional groups forming an extension of the apparatus in conveying direction III:

According to FIG. 1, a modified third conveying segment 50' may be provided by which, unlike in FIG. 6, a third conveying section 50*a* is formed following back-up roller 55, in which the pieces of mail are carried along once more displaceably. Then they pass into the seizure zone of a retarding device 60 which, in this example, comprises further pairs of conveying rollers 61,62 and 63 and extends perpendicularly to the third direction III, with the conveying speed being lower than before in the third conveying segment. Then, the pieces of mail move on in a way permitting the provision of another alignment. Retarding device 60 is followed by a normal further conveying apparatus 7 having the same speed of conveyance.

Instead, in another modification within the scope ( the invention, an additional alignment of the pieces ( mail which are translationally moved away, may b obtained by providing that the circumferential speed ( the pairs of conveying rollers 41 to 43 in second deflec ing device 40 is lower than the conveying speed comp( nent in the third direction III of second direction I The said lower speed of conveyance is thus provided i the following third conveying segment 50 according t FIGS. 2 and 6.

It will be understood that conveying rollers 21 to 2 41 to 43, and 61 to 63 of deflecting device 20,20*a* and 4 and of retarding device 60 must have surfaces with high coefficient of friction, and that they must be cap ble, in a known manner, of adapting to various thicl nesses of the letters. This may be obtained, for exampl by providing the shaft of the respective lower roller ( each pair of rollers in fixed position, while the shaft ( the upper roller is mounted on a pivotal arm. It ma even suffice to provide the upper fixedly mounted ro lers with a thick elastic coating. In roller pairs 41 to 4 and 61 to 63, the respective lower rollers may be carrie on a common shaft and the upper rollers may b mounted separately on pivotal arms or, if provided wit a thick elastic coating, also on a common shaft.

Even though, as a rule, the mentioned rollers ar driven in a manner such that the rollers belonging to th same deflecting device have mutually equal circumfe ential speeds, it would still be within the scope of th invention to drive the rollers, for example those of ro ler pairs 21 to 24 of frist deflecting device 20, at slightl different, properly related, circumferential speeds, t accommodate to certain operating conditions.

I claim:

1. An apparatus for angularly changing the directio of motion of pieces of mail having a long edge and short edge, from a direction of their long edge to direction of their short edge, comprising:

a first conveying segment extending in a first direc tion for seizing and positively feeding a piece c mail in a plane with its long edge moving along reference line and its short edge forward, said firs conveying segment having a first conveying sec tion at a downstream end thereof in which th piece of mail is displaceably moved in said firs direction;

a first set of deflecting rollers by which the piece c mail is seized at its short edge and moved parallel away from said first conveying section in a secon direction which is co-planar with said first direc tion and which forms an acute angle of at most 45 with said first direction;

a second conveying segment which extends in sai co-planar second direction for receiving, seizin and positively feeding the piece of mail moved b said first deflecting device, said second conveyin segment having a second conveying section at downstream end thereof in which the piece of ma is displaceably moved in said second direction; an a second set of deflecting rollers by which the piec of mail is seized at its long edge and moved para lely away from said second conveying section in co-planar third direction which forms an angle c about 90° to said first direction and is co-plana with said first direction.

2. An apparatus according to claim 1 wherein said first conveying segment includes a conveying device upstream of said first conveying section for feeding the piece of mail in a substantially horizontal plane along their long edge.

3. An apparatus according to claim 2, including a third set of deflecting rollers positioned between said first set of deflecting rollers and said second set of deflecting rollers, by which the piece of mail is seized and moved parallely away from said second direction to a fourth direction and to said second set of deflecting rollers, said fourth direction being intermediate between said second and third directions.

4. An apparatus to claim 1, wherein said first and second conveying sections each comprise a first conveying belt on which the piece of mail lies flatly when moved, and a second conveying belt which is trained over said first conveying belt covering at least a portion of the length of said first conveying belt in a manner so as to exert at most a slight pressure contact with the piece of mail on said first conveying belt; and said first belt extending beyond the end of said second belt in the direction of travel of the piece of mail.

5. An apparatus according to claim 4, wherein each of said first and second conveying sections include at least one deflecting roller engaged with said second conveying belt for training said second conveying belt in a direction out of contact with said first conveying belt.

6. An apparatus according to claim 5, wherein said deflecting roller trains said second conveying belt at a small angle with respect to and away from said first conveying belt in a conveyance direction of said first and second conveying belts.

7. An apparatus according to claim 5, wherein said deflecting roller trains said second conveying belt in a direction parallel to and slightly spaced from said first conveying belt.

8. An apparatus according to claim 4, including a stopping surface extending adjacent said second set of deflecting rollers and in a location to engage a leading edge of the piece of mail moving in said second direction.

9. An apparatus according to claim 8, wherein said stopping surface is positioned to engage the leading edge of the piece of mail as soon as the long edge of the piece of mail is seized by said second set of deflecting rollers.

10. An apparatus according to claim 8, wherein said stopping surface comprises a conveyer belt.

11. An apparatus according to claim 1, including a third conveying segment extending in said third direction for siezing the piece of mail as it comes from said second set of deflecting rollers.

12. An apparatus according to claim 11, wherein said third conveying segment includes a third conveying section at a downstream end thereof for displaceably moving the piece of mail, a retarding device positioned downstream of said third conveying section having a piece of mail seizing zone extending substantially perpendicularly to said third direction and a conveying speed which is lower than the conveying speed of said third conveying segment.

13. An apparatus according to claim 12, wherein said retarding device comprises a plurality of conveying rollers operating in pairs to define nips therebetween forming said seizing zone.

14. An apparatus according to claim 1, wherein said first set of deflecting rollers comprises a plurality of conveying rollers cooperating in pairs to form a plurality of nips therebetween, with at least two pairs of conveying rollers arranged in a path of conveyance for seizing a leading edge of the piece of mail substantially simultaneously and at least one pair of conveying rollers positioned to receive a lateral edge of the piece of mail at a relatively small lateral distance from said reference line, said conveying rollers being angularly disposed relative to said first conveying section for laterally shifting the piece of mail siezed thereby.

15. An apparatus for angularly changing the direction of motion of flat articles having a long edge and a short edge along a path from a direction of their long edge to a direction of their short edge comprising:

a first conveying segment including a pair of endless belts (13, 15), each having an upper and lower run, said belts being superposed one above the other so that the lower run portion of the upper belt is disposed contiguous the upper run of the lower belt at an inlet end of said first conveying segment, said upper run of the lower belt extending beyond the lower run of the upper belt to define an exit end, said upper and lower runs of said pair of belts being slightly spaced at said exit end for displaceably transporting a flat article therebetween toward said exit end;

first deflecting means (20) disposed adjacent said exit end, said first deflecting means including a pair of superposed conveying rollers defining a nip therebetween for seizing the article displaceably exiting said exit end, the axis of said conveying rollers being angularly disposed relative to an axis of said first conveying segment;

a second conveying segment disposed at an acute angle relative to the axis of said first conveying segment, said second conveying segment including a second pair of endless conveyor belts (33, 37), each having an upper and lower run, said second pair of conveyor belts being superposed so that the lower run of the upper belt of said second pair of conveyor belts is disposed contiguous to the upper run of the lower belt of said second pair of endless belts at an inlet end of said second conveying segment, and the upper run of said lower belt of said second pair of belts extends beyond the lower run of said upper belt, whereby the article carried on said extended end is displaceably supported thereon;

second deflecting means (40), said second deflecting means including a pair of superposed rollers defining a nip therebetween for seizing the article exiting from the exit end of said second conveying segment; and a third conveying segment, said third conveying segment angularly disposed relative to said first conveying segment at an angle of about 90°, said third conveyor segment including a third pair of superposed endless belts (53, 54), each having an upper and lower run, whereby the lower run of said belt of said third conveyor segment being disposed contiguous to the upper run of said lower endless belt of said third conveyor segment at an inlet end of said third conveying segment;

each of said first, second and third pair of endless belts thereby seizing the flat article at the inlet end thereof and displaceably supporting the flat article at the exit end thereof, whereby the flat article travels in a co-planar path.

* * * * *